United States Patent [19]

Rey et al.

[11] 4,407,414

[45] Oct. 4, 1983

[54] WRAPPER FOR KITCHEN UTENSILS

[75] Inventors: Pierre Rey; Emile Bonnet, both of Rumilly, France

[73] Assignee: SEB S.A., Selongey, France

[21] Appl. No.: 416,958

[22] Filed: Sep. 9, 1982

[30] Foreign Application Priority Data

Sep. 30, 1981 [FR] France ..... 81 18393

[51] Int. Cl.[3] ..... B65D 6/04

[52] U.S. Cl. ..... 206/553; 206/516; 229/87 H; 229/40

[58] Field of Search ..... 206/15.3, 216, 436, 206/491, 492, 495, 553, 516; 229/40, 87 R, 87 H

[56] References Cited

U.S. PATENT DOCUMENTS

| | | | |
|---|---|---|---|
| 2,083,741 | 6/1937 | Pearson | 229/87 R |
| 2,290,359 | 7/1942 | Ringler | 229/87 H |
| 2,471,173 | 5/1949 | Taylor | 229/40 |
| 3,003,207 | 10/1961 | Powers | 206/491 |
| 3,773,170 | 11/1973 | Rossi | 206/216 |
| 3,869,079 | 3/1975 | Oglesbee | 206/491 |
| 3,923,236 | 12/1975 | Calvert | 229/40 |
| 4,137,333 | 1/1979 | Daswick | 229/40 |
| 4,262,814 | 4/1981 | Roccaforte | 229/40 |

*Primary Examiner*—William Price
*Assistant Examiner*—David Fidei
*Attorney, Agent, or Firm*—Young & Thompson

[57] ABSTRACT

The wrapper is made from a sheet of semi-rigid and foldable material such as paperboard and has two surfaces which are cut-out of the sheet. The two surfaces are applied respectively against the internal face and the external face of the bottom of the utensil. The surfaces are joined to each other by means of four tongues spaced at intervals around the lateral wall of the utensil. The tongues cover the free edge of the side wall and are applied against the internal and external faces of the wall.

14 Claims, 9 Drawing Figures

WRAPPER FOR KITCHEN UTENSILS

This invention relates to a packaging wrapper for a kitchen utensil having a bottom wall and a side wall such as a saucepan, a deep or shallow frying-pan and the like.

The invention is also directed to a method for equipping a kitchen utensil by means of the wrapper aforesaid.

At the time of storage, transportation and handling of kitchen utensils for subsequent marketing, such utensils are exposed to many shocks which are liable to damage the coating of fluorocarbon resin, enamel or other materials with which these utensils are coated on internal surfaces and sometimes on external surfaces.

It is consequently essential to wrap utensils of this type with great care. In order to meet this requirement, these utensils are usually wrapped by hand in a sheet of wrapping paper or paperboard which entirely covers the utensil and thus completely conceals it.

This type of wrapper is unsatisfactory for many reasons. In the first place, on account of the rounded and complex shape of kitchen utensils, the wrapping operation takes a relatively long time and the appearance of the wrapper is unattractive owing to the presence of inevitable folds.

In the second place, the fact that the utensil is completely masked by the wrapper makies it impossible to distinguish its origin and its technical characteristics as well as its attractive appearance, thus constituting a drawback both for vendors and users.

Another drawback lies in the fact that this type of wrapper has insufficient strength since it is too thin and incapable of absorbing shocks to a sufficient extent.

Furthermore, these wrappers are not compatible with the stackability of kitchen utensils, especially in the case of frying pans.

It has also been proposed to utilize paperboard wrappers consisting of two disks applied respectively internally and externally against the bottom of the utensil and joined together by means of strips of paperboard surrounding the top rim of the utensil and applied against the internal and external faces of the side wall of the utensil.

These wrappers are convenient to use and to place in position but fail to provide the internal face of utensils with a sufficient degree of protection, especially at the time of stacking.

The object of the present invention is to overcome the disadvantages of the designs mentioned in the foregoing by producing a wrapper which is easy to manufacture and to place in position, which provides effective protection of utensils against shocks, and which does not completely mask these latter.

The wrapper contemplated by the invention is made from a sheet of semi-rigid and foldable material such as paperboard and has two surfaces which are cut-out of the sheet, said two surfaces being applied respectively against the internal face and the external face of the bottom of the utensil.

The essential feature of the invention lies in the fact that the two surfaces aforesaid are joined to each other by means of at least three tongues spaced at intervals around the side wall of the utensil, said tongues being adapted to cover the free edge of said wall and being applied against the internal and external faces of said wall.

Since the two cut-out surfaces are joined together by means of at least three tongues spaced at intervals around the side wall of the utensil, the wrapper cannot slip laterally with respect to the utensil. Moreover, at the time of stacking of utensils, there is no possibility of direct contact between internal and external surfaces of the utensils and consequently no potential danger of damage to the coatings as a result of such contact.

Furthermore, said tongues of semi-rigid material such as paperboard necessarily form an empty space between these latter and the curved internal surface of the side wall of each utensil. The tongues can thus intimately correspond in shape to the utensil wall which is applied against said tongues while ensuring a certain degree of shock-absorption.

In addition, said tongues mask only part of the utensil, with the result that the characteristics and decorative appearance of said utensil remain visible.

In an advantageous embodiment of the invention, the wrapper has four tongues in uniformly spaced relation around the side wall of the utensil.

The four tongues thus arranged make it possible to simplify cutting-out and positioning of the wrapper.

Moreover, the presence of four tongues permits easy stacking of utensils by displacing these latter successively at an angle of 45° with respect to each other.

In a preferred embodiment of the invention, one of the tongues is provided on the portion located opposite to the external face of the side wall of the utensil with a cut-out opening for the insertion of the handle of the utensil. This opening serves to secure the wrapper to said handle, with the result that the position of the wrapper is perfectly defined with respect to the utensil.

The wrapper can be formed in a single piece. A certain number or all of the tongues can also be attached by gluing to either of the two cut-out surfaces.

In a particular embodiment of the invention, provision is made for a tag cut-out from the opening for the insertion of the handle of the utensil and joined to that edge of said opening which is adjacent to the bottom of the utensil, said tag being folded-back against the fixing sleeve of said handle.

At the time of stacking of utensils, said tag serves to prevent any direct contact between the sleeve or rivet for attaching the handle of an upper utensil and the top rim of a lower utensil.

In a preferential embodiment of the invention, when the wrapper is in the developed state on a flat surface, the two cut-out surfaces are joined together by means of an intermediate tongue and one of these surfaces has two opposite tongues at right angles to the first tongue and a fourth tongue located opposite to the first, said fourth tongue being provided with the cut-out opening for insertion of the handle of the utensil.

In order to equip a culinary utensil by means of a wrapper of this type, the following procedure is adopted in accordance with the invention:

The cut-out opening of the tongue is engaged in the handle of the utensil, the cut-out surface is applied against the internal face of the bottom of the utensil, the two opposite tongues are folded-back towards the external face of the bottom of the utensil, the last tongue is folded-back and the other cut-out surface which is joined to this latter is folded-back towards the external face of the bottom of the utensil and over the ends of the two opposite tongues, the cut-out surface is attached by gluing to the ends of said tongues and to the end of the tongue provided with the cut-out opening.

Other features of the invention will be more apparent upon consideration of the following description and accompanying drawings, wherein.

Figure 1:
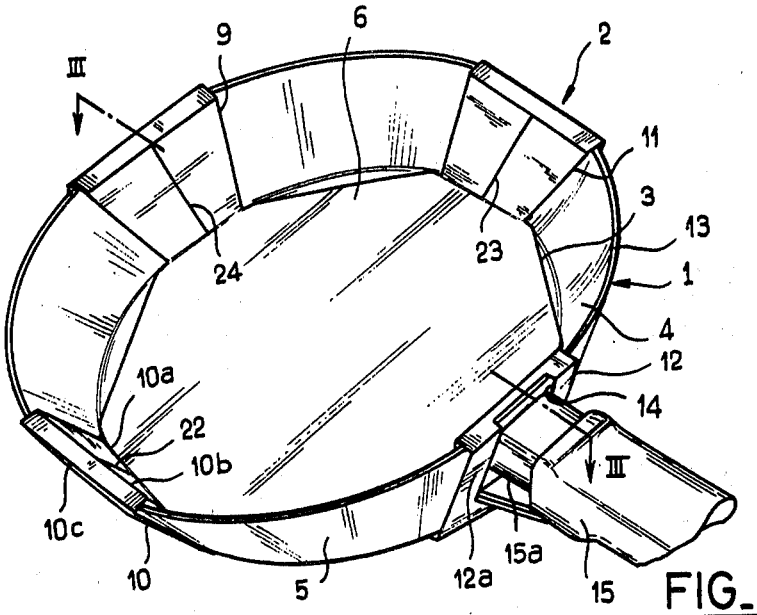
FIG. 1 is a view in perspective showing the interior of a frying pan covered with a wrapper according to the invention.

In the embodiment of FIGS. 1 to 4, the circular frying pan 1 is covered with a wrapper 2 cut from a sheet of paperboard. The internal face 3 of the bottom and the internal face 4 of the side wall of said frying pan are provided with a coating of fluorocarbon resin such as polytetrafluoroethylene. The external face 5 of the side wall of the utensil is provided with a coating of polytetrafluoroethylene or of enamel.

The wrapper 2 has two cut-out surfaces 6, 7 applied respectively against the internal face 3 and the external face 8 of the bottom of the frying pan 1. These two cut-out surfaces 6, 7 have a substantially hexagonal shape which is inscribed within the circles delimiting the internal face 3 and external face 8 of the bottom of the frying pan.

These two cut-out surfaces 6, 7 are joined to each other by means of four tongues 9, 10, 11, 12 arranged in uniformly spaced relation around the side wall of the frying pan 1 and cover the top rim 13 of said side wall while being applied against the internal face 4 and external face 5 of said wall.

Figure 2:
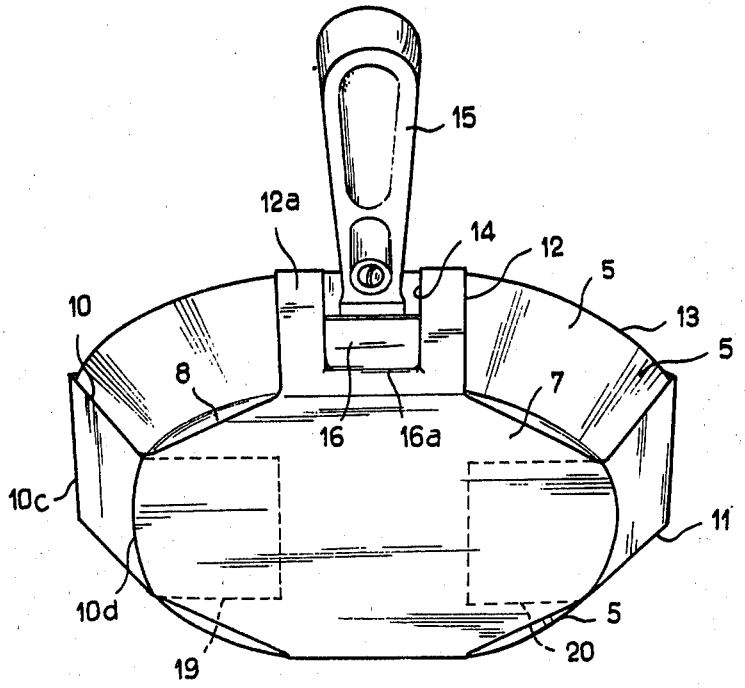
FIG. 2 is another view in perspective showing the exterior of the frying pan.

As shown in FIG. 2, the portion 12*a* of the tongue located opposite to the external face 5 of the side wall of the utensil is provided with a rectangular opening 14 which has been cut-out of this portion for the insertion of the handle 15 of the frying pan 1.

The tongues 9, 10, 11, 12 are each provided with preformed pleats such as those designated by the references 10*a*, 10*b*, 10*c*, 10*d*. Said pleats are parallel to each other and perpendicular to a radius of the circle within which is inscribed each cut-out surface 6 and 7.

The distances between the pleats 10*a* and 10*b*, the pleats 10*b* and 10*c* and the pleats 10*c* and 10*d* are adapted respectively to the height of the internal face 4, to the thickness and to the height of the external face 5 of the side wall of the utensil.

Figure 4:
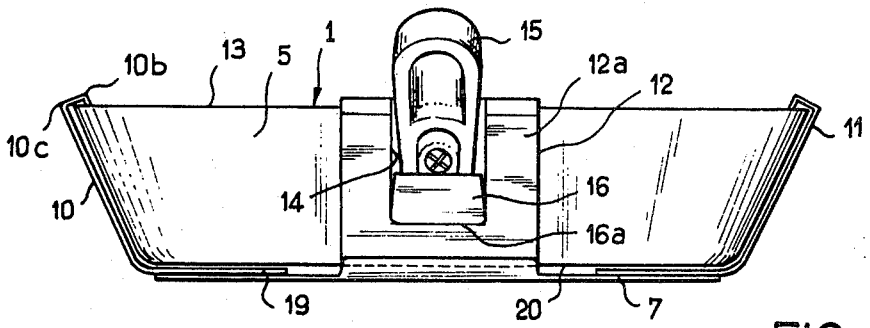
FIG. 4 is a side view along the axis of the handle of the utensil.
Figure 5:
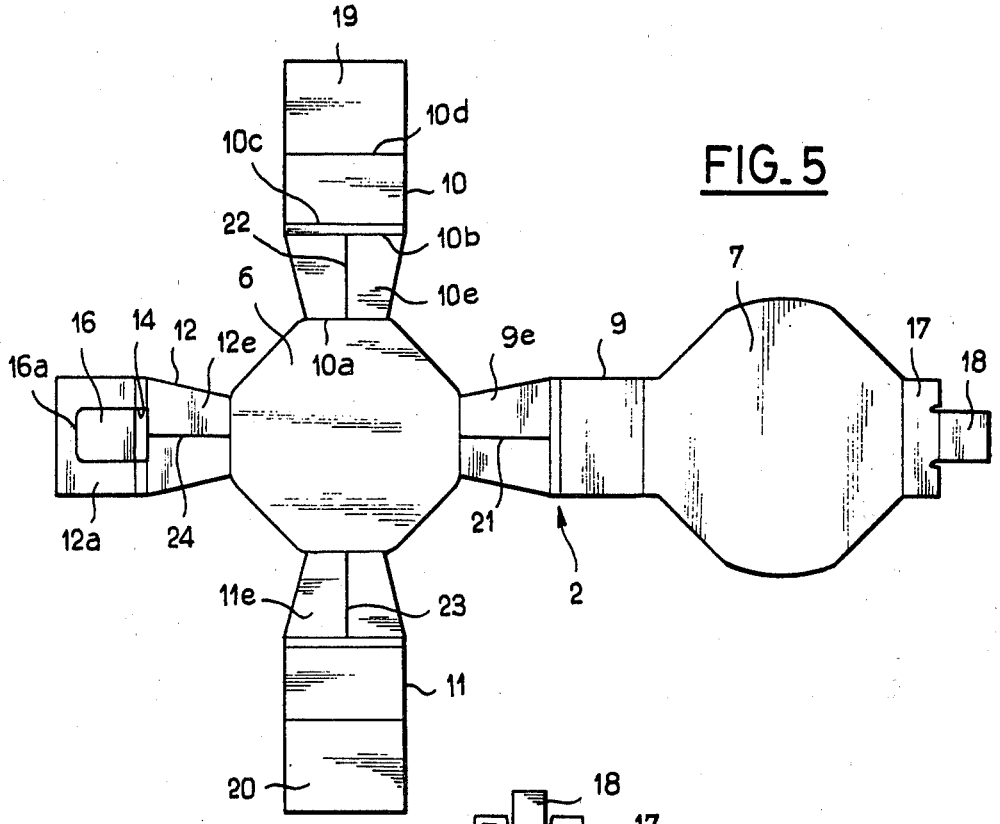
FIG. 5 is a plan view of the wrapper in the developed state.

In the example shown in the drawings, the wrapper 2 is formed in a single piece as can be seen in particular in FIG. 5 which shows said wrapper in the developed state on a flat surface. In FIG. 5, it is observed that the two cut-out surfaces 6, 7 are joined together by means of the tongue 9. The cut-out surface 6 which is intended to be applied inside the frying pan 1 has two opposite tongues 10, 11 at right angles to the tongue 9. The fourth tongue 12 in which is formed the cut-out opening 14 for the insertion of the handle 15 is located on the side opposite to the intermediate tongue 9. In FIG. 5 as well as in FIGS. 2, 3 and 4, it is seen that the wrapper 2 has a tag 16 cut from the opening 14 for the insertion of the handle 15. Said tag 16 is joined by means of a preformed pleat 16*a* to that edge of said opening which is adjacent to the bottom of the frying pan 1. Said tag 16 (as shown in FIGS. 2, 3, 4) is folded-back against the metal fastening sleeve 15*a* of the handle 15.

The cut-out surface 7 which is intended to be applied against the external face 8 of the bottom of the utensil is provided at the end remote from the intermediate tongue 9 with a short tongue 17 which is in turn provided at the free edge thereof with a cut-out strip 18 of smaller width than said tongue 17.

Figure 3:
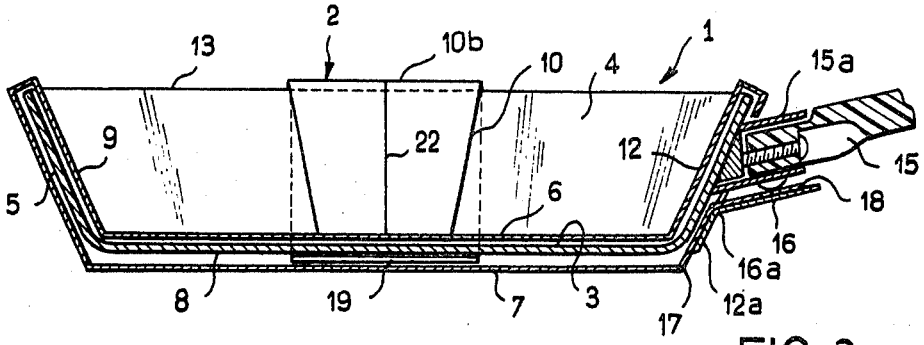
FIG. 3 is a sectional view taken along the plane III--III of FIG. 1.

When the wrapper is formed (as shown in FIG. 3), said strip 18 is engaged within the cut-out opening 14 for the insertion of the handle 15 and covers the tag 16 formed by cutting from said opening.

It is also evident from FIG. 5 that the opposite tongues 10 and 11 are extended beyond the external pleat such as the pleat 10*d* by end flaps 19, 20 which are inserted between the bottom of the frying pan and the cut-out surface 7 when the wrapper has been formed and are glued against said surface (as shown in FIGS. 2 and 3).

Similarly, it is apparent from FIG. 3 that the short tongue 17 is inserted between the external surface 5 of the side wall of the frying pan and the end of the tongue 12 and is glued to this latter. The strip 18 carried by said short tongue 17 is also glued against the tag 16 which is cut from the opening 14.

It can also be observed in FIGS. 1, 3 and 5 that the portion 9*e*, 10*e*, 11*e*, 12*e* of tongues 9 to 12 which is applied against the internal face 4 of the side wall of the frying pan has the shape of a trapezium, the small base of which corresponds to the preformed pleats such as the pleat 10*a* and is joined to the cut-out surface 6.

Furthermore, the portions 9*e*, 10*e*, 11*e* and 12*e* of the tongues 9 to 12 have a rectilinear cut 21, 22, 23, 24 which extends in the direction of the height of the internal face 4 of the side wall of the frying pan, that is to say between the preformed pleats such as the pleats 10*a* and 10*b*.

Cutting-out of the paperboard sheet in order to obtain the developed wrapper 2 shown in FIG. 5 can be performed by means of an automatic cutting-out machine. The different pleats such as those designated by the references 10*a*, 10*b* and so on can also be preformed automatically.

Figure 6:
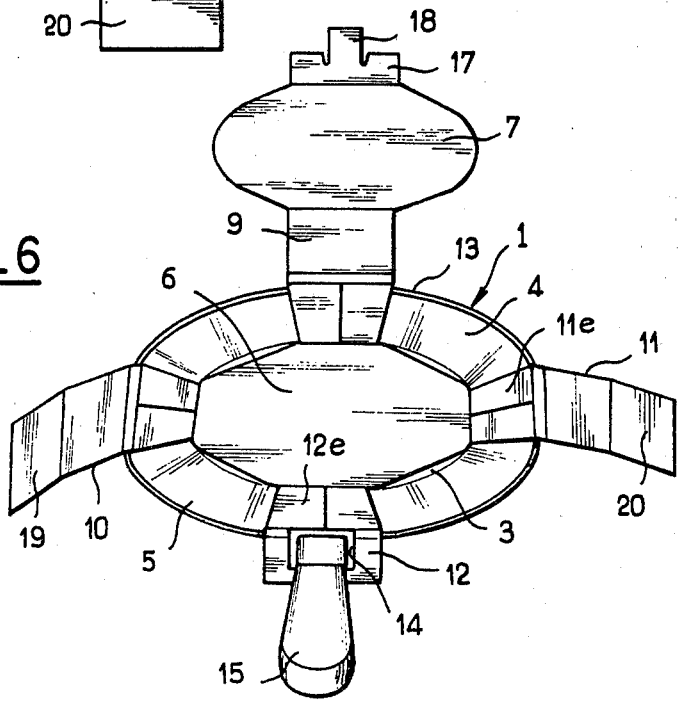
FIG. 6 is a view in perspective illustrating a first step of the method of wrapping.

In order to wrap the frying pan 1 with the developed wrapper as shown in FIG. 5, the procedure adopted can be as follows:

In a first step (as shown in FIG. 6), the cut-out opening 14 of the tongue 12 is engaged over the handle 15 of the frying pan and the cut-out surface 6 is applied against the internal face 3 of the bottom of the frying pan.

Figure 7:
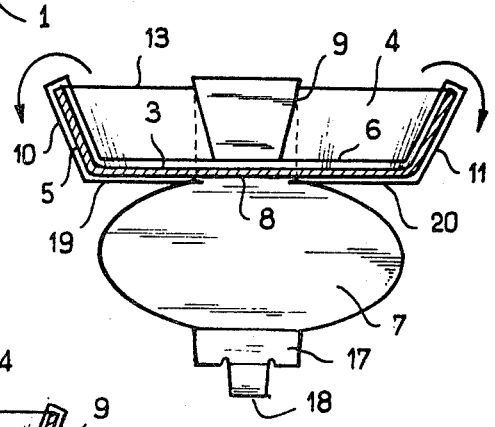
FIG. 7 is a sectional view of the utensil and shows a second step of the method of wrapping.

In a second step (as shown in FIG. 7), the two opposite tongues 10 and 11 are folded back towards the external face 8 of the bottom of the frying pan and the end flaps 19 and 20 are applied against said face 8.

Figure 8:
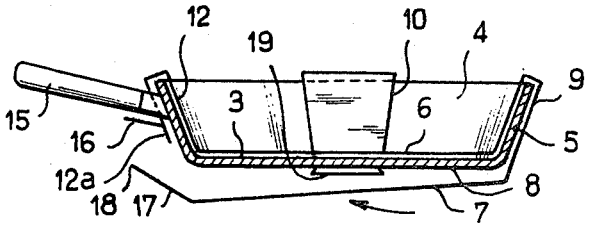
FIG. 8 is a view which is similar to FIG. 7 and shows a third step of the method.

The last tongue 9 and the other cut-out surface 7 which is joined to this latter are then folded back against the external face 8 of the bottom of the frying pan (as shown in FIG. 8).

The cut-out surface 7 is applied against the preglued end flaps 19 and 20 of the tongues 10 and 11.

The strip 18 located at the end of the short tongue 17 is then engaged between the external face 5 of the side wall of the frying pan and the portion 12*a* of the tongue 12. Said strip 18 is then inserted in the opening 14 of the tongue 12 and placed between the handle 15 and the tag 16 which has been cut from the opening 14 aforesaid.

The short tongue 17 is attached to the portion 12*a* of the tongue 12 by gluing. Similarly, the strip 18 is glued against the tag 16. In both cases, gluing can be carried out by means of pre-glued zones formed on the parts to be assembled.

The operations mentioned in the foregoing can be performed automatically and in series by means of a machine.

The wrapper thus obtained offers many advantages.

Figure 9:
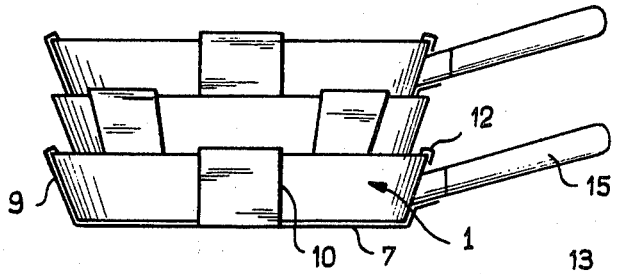
FIG. 9 is a view in elevation showing three wrapped utensils stacked one above the other.

Thus, as illustrated in FIG. 9, the wrapper permits stacking of a number of wrapped frying pans.

To this end, the frying pans need only be displaced successively through an angle of 45° in order to prevent the tongues 9, 10, 11, 12 from being superposed since this would interfere with stacking.

In this position, any direct contact between a frying pan and the internal and external coatings of another frying pan is prevented.

Furthermore, a free space remains between the tongues 9, 10, 11 and 12 and the internal face 4 of the side wall of each frying pan. Said free space permits deformation of the tongue in contact with the wall of another frying pan while producing a certain shock-absorbing action. This action is enhanced by the presence of the rectilinear cuts 21, 22, 23 and 24 which also have a locking effect, thus tending to maintain the tongues 9, 10, 11, 12 in the position in which they are folded back towards the side wall of the frying pan.

It is also worthy of note that the wrapper according to the invention not only ensures a high degree of protection but also covers only a small portion of the side wall of the frying pan. This feature enables the user in particular to examine the characteristics of the coating without any need to unwrap the frying pan. Unwrapping of the frying pan is nevertheless very easy since it is only necessary to tear-off one or two tongues.

Another noteworthy feature is that the wrapper according to the invention is securely attached to the utensil and is not liable in particular to slide with respect to this latter.

Moreover, the metallic sleeve 15*a* or the rivet used for fixing the handle 15 is not liable to damage the top rim 13 of a frying pan located underneath by reason of the fact that said sleeve is covered by a double layer of paperboard constituted by the tag 16 and the strip 18 which are bonded together by gluing.

As will readily be understood, the invention is not limited to the example which has just been described and many modifications may accordingly be contemplated without thereby departing from the scope of the invention.

From this it follows that the wrapper 2 can be of corrugated board, of plastic material or of any other semi-rigid and foldable material having similar mechanical properties.

The number of tongues 9 to 12 can be greater or smaller than four but at least equal to three.

The cut-out surfaces 6 and 7 need not be hexagonal but can be circular or have the shape of an octagon or any other polygon.

The cut-out surfaces 6 or 7 can also be provided with open portions in order that part of the internal and/or external bottom surface of the frying pan may thus be made visible.

The wrapper can be made of several parts glued to each other, in which case the method of wrapping can be different from the method hereinabove described by way of example.

The wrapper can also be employed for wrapping utensils with handles such as saucepans or shallow frying pans or utensils without handles.

What is claimed is:

1. A wrapper for kitchen utensils which have a bottom wall and a side wall, said wrapper being made from a sheet of semi-rigid foldable material such a paperboard having two planar surfaces which are cut-out of the sheet to a size approximate the area of the bottom wall, said two surfaces being applied respectively against the internal face and the external face of the bottom of the utensil, wherein the two surfaces aforesaid are joined to each other by means of at least three tongues spaced at intervals around the side wall of the utensil, said tongues being adapted to cover the top rim of said side wall and being applied against the internal and external faces of said wall.

2. A wrapper according to claim 1, wherein said wrapper comprises four tongues disposed in uniformly spaced relation around the side wall of the utensil.

3. A wrapper according to claim 1 or claim 2, wherein one of the tongues is provided on the portion located opposite to the external face of the side wall of the utensil with a cut-out opening for the insertion of the handle of the utensil.

4. A wrapper according to claim 1, wherein said cut-out surfaces are inscribed respectively within the internal and external surfaces of the bottom of the utensil.

5. A wrapper according to claim 1 for a utensil having a circular bottom, wherein the tongues are provided with preformed pleats which are parallel to each other and perpendicular to a radius of the circle within which each surface cut-out from the sheet is inscribed.

6. A wrapper according to claim 1, wherein said wrapper is formed in a single piece.

7. A wrapper according to claim 1, wherein the tongues are attached by gluing to at least one of the cut-out surfaces.

8. A wrapper according to claim 6 or claim 7 wherein, in the developed state on a flat surface, the two cut-out surfaces are joined together by means of a tongue and one of said surfaces is provided with two opposite tongues at right angles to the first tongue and with a fourth tongue located opposite to the first, said fourth tongue being provided with the cut-out opening for the insertion of the handle of the utensil.

9. A wrapper according to claim 3, wherein said wrapper is provided with a tag cut-out from the opening for insertion of the handle and joined to that edge of said opening which is adjacent to the bottom of the utensil, said tag being folded back against the sleeve which serves to attach the handle.

10. A wrapper according to claim 9, wherein the cut-out surface which is adjacent to the external face of the bottom of the utensil is provided opposite to a tongue joined to the other cut-out surface with a strip which is intended after formation of the wrapper to be engaged within the cut-out opening provided for insertion of the handle and to cover the tag cut in said opening, said strip being glued to said tag.

11. A wrapper according to claim 1, wherein the tongues are provided with a rectilinear cut on those portions of said tongues which are applied against the internal face of the side wall of the utensil, said rectilinear cuts being adapted to extend in the direction of the height of said internal face.

12. A wrapper according to claim 1, wherein those portions of the tongues which are applied against the internal face of the side wall of the utensil each have the shape of a trapezium whose small base is joined by means of a preformed rectilinear pleat to the cut-out surface applied against the bottom of the utensil.

13. A method for wrapping kitchen utensils by means of a wrapper according to claim 8, wherein the cut-out opening of the tongue is engaged over the handle of the utensil, the cut-out surface is applied against the internal face of the bottom of the utensil, the two opposite tongues are folded-back towards the external face of the bottom of the utensil, the last tongue is folded-back and the other cut-out surface which is joined to said last tongue is folded-back towards the external face of the bottom of the utensil and over the ends of the two opposite tongues, the cut-out surface is attached by gluing to the ends of said tongues and to the end of the tongue provided with the cut-out opening.

14. A method according to claim 13, wherein the strip joined to the cut-out surface is engaged within the cut-out opening of the tongue and said strip is attached by gluing against the tag which is cut from said opening.

* * * * *